US012708159B2

(12) United States Patent
Worple

(10) Patent No.: US 12,708,159 B2
(45) Date of Patent: Aug. 18, 2026

(54) PADDING MATERIAL FOR PROTECTIVE EQUIPMENT

(71) Applicant: Milwaukee Electric Tool Corporation, Brookfield, WI (US)

(72) Inventor: Joseph R. Worple, Menomonee Falls, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 18/956,844

(22) Filed: Nov. 22, 2024

(65) Prior Publication Data

US 2025/0221476 A1 Jul. 10, 2025

Related U.S. Application Data

(60) Provisional application No. 63/617,844, filed on Jan. 5, 2024.

(51) Int. Cl.

| | |
|---|---|
| ***A41D 13/06*** | (2006.01) |
| ***A41D 13/015*** | (2006.01) |
| *A42B 3/12* | (2006.01) |

(52) U.S. Cl.
CPC ..... *A41D 13/065* (2013.01); *A41D 13/015* (2013.01); *A42B 3/125* (2013.01)

(58) Field of Classification Search
CPC ..... A41D 13/065; A41D 13/015; A42B 3/125
See application file for complete search history.

(56) References Cited

U.S. PATENT DOCUMENTS

| | | | | |
|---|---|---|---|---|
| 5,168,576 | A | 12/1992 | Krent et al. | |
| 5,423,087 | A | 6/1995 | Krent et al. | |
| 5,450,625 | A * | 9/1995 | Hu | A63B 71/1225 2/22 |
| 5,496,610 | A * | 3/1996 | Landi | B29D 24/005 428/116 |
| 5,840,397 | A | 11/1998 | Landi et al. | |
| 5,915,529 | A * | 6/1999 | Popowski | A41D 13/08 2/24 |

(Continued)

FOREIGN PATENT DOCUMENTS

| | | |
|---|---|---|
| CN | 111838803 | 10/2020 |
| CN | 113058255 | 4/2022 |

(Continued)

OTHER PUBLICATIONS

"Protective Patterns", Troy Turner, <https://www.yankodesign.com/author/troy-turner/>, Aug. 28, 2009, 22 pages.

(Continued)

*Primary Examiner* — Khaled Annis
(74) *Attorney, Agent, or Firm* — Reinhart Boerner Van Deuren s.c.

(57) ABSTRACT

A padding material for protective equipment is provided. The padding material is formed from a single, integral piece of material with a cellular structure. The size and/or shape of the cellular structure is non-uniform to provide support and reduce pressure in chosen areas. One embodiment of the protective equipment includes knee pad with a shell, padding disposed in front of the knee of the wearer, the padding including a non-uniform stiffness.

21 Claims, 18 Drawing Sheets

(56) References Cited

U.S. PATENT DOCUMENTS

| | | | | |
|---|---|---|---|---|
| 5,924,140 | A | 7/1999 | Chi | |
| 5,987,643 | A * | 11/1999 | Beutler | A41D 13/0562 2/24 |
| 6,093,468 | A | 7/2000 | Toms et al. | |
| 6,151,714 | A | 11/2000 | Pratt | |
| 7,018,351 | B1 * | 3/2006 | Iglesias | A61F 5/0111 602/5 |
| 7,608,314 | B2 | 10/2009 | Plant | |
| 7,874,017 | B2 | 1/2011 | Jones | |
| 7,900,271 | B2 * | 3/2011 | Sonner | F41H 1/02 2/24 |
| 8,425,712 | B2 | 4/2013 | Turner | |
| 8,702,895 | B2 | 4/2014 | Turner | |
| 9,015,862 | B2 | 4/2015 | Wood | |
| 9,272,500 | B2 | 3/2016 | Turner | |
| 9,375,041 | B2 | 6/2016 | Plant | |
| 9,545,127 | B1 | 1/2017 | Sandifer | |
| 10,159,295 | B2 * | 12/2018 | Frey | A42B 3/065 |
| 10,427,376 | B2 | 10/2019 | Huckey et al. | |
| 11,311,060 | B2 | 4/2022 | Ferrara | |
| 11,457,683 | B2 | 10/2022 | Plant | |
| 11,571,036 | B2 * | 2/2023 | Stone | A42B 3/065 |
| 2005/0120454 | A1 * | 6/2005 | Cunningham | A41D 13/0568 2/24 |
| 2006/0041986 | A1 * | 3/2006 | Godshaw | A41D 13/0568 2/24 |
| 2008/0289073 | A1 * | 11/2008 | Jones | A41D 13/065 2/24 |
| 2009/0070911 | A1 | 3/2009 | Chang | |
| 2009/0307829 | A1 | 12/2009 | Onrot et al. | |
| 2010/0161076 | A1 | 6/2010 | Pallari | |
| 2011/0033655 | A1 * | 2/2011 | Duchene | B32B 27/18 428/116 |
| 2012/0030850 | A1 * | 2/2012 | Wood | A47C 16/02 2/24 |
| 2012/0260392 | A1 | 10/2012 | Votel et al. | |
| 2014/0081601 | A1 | 3/2014 | Zhang et al. | |
| 2014/0182170 | A1 | 7/2014 | Wawrousek et al. | |
| 2015/0000018 | A1 | 1/2015 | Brandt | |
| 2015/0075697 | A1 * | 3/2015 | Gildersleeve | A61F 13/0253 156/60 |
| 2015/0101899 | A1 | 4/2015 | Russo | |
| 2015/0351467 | A1 | 12/2015 | Simoes | |
| 2016/0349738 | A1 | 12/2016 | Sisk | |
| 2017/0213382 | A1 | 7/2017 | Torvinen et al. | |
| 2018/0021661 | A1 | 1/2018 | Bologna et al. | |
| 2018/0092428 | A1 | 4/2018 | Knight | |
| 2018/0228401 | A1 | 8/2018 | Schwartz et al. | |
| 2018/0255862 | A1 * | 9/2018 | Ho | A42B 3/064 |
| 2019/0145740 | A1 * | 5/2019 | Czerski | B32B 5/02 2/463 |
| 2020/0100554 | A1 | 4/2020 | Bologna et al. | |
| 2020/0138141 | A1 | 5/2020 | Kwok et al. | |
| 2020/0154803 | A1 | 5/2020 | Goulet et al. | |
| 2020/0282655 | A1 | 9/2020 | Plant et al. | |
| 2021/0001560 | A1 | 1/2021 | Cook et al. | |
| 2022/0211123 | A1 | 7/2022 | Ferrara | |
| 2022/0275845 | A1 | 9/2022 | Kabaria et al. | |
| 2022/0322764 | A1 * | 10/2022 | Williams | A41D 13/0568 |
| 2023/0008082 | A1 | 1/2023 | Plant | |
| 2024/0016242 | A1 * | 1/2024 | Garcia | A41D 13/0568 |
| 2024/0099400 | A1 | 3/2024 | Lombardi et al. | |

FOREIGN PATENT DOCUMENTS

| | | |
|---|---|---|
| CN | 217487718 | 9/2022 |
| CN | 113975779 | 1/2023 |
| CN | 112471638 | 6/2023 |
| CN | 116236763 | 6/2023 |
| CN | 219556394 | 8/2023 |
| DE | 102016006113 | 11/2017 |
| DE | 202022105672 | 11/2022 |
| EP | 3053462 | 8/2016 |
| EP | 3075274 | 10/2016 |
| EP | 3165109 | 5/2017 |
| EP | 3558046 | 10/2022 |
| EP | 4186381 | 5/2023 |
| WO | WO2018/048880 | 3/2018 |
| WO | WO2018/072017 | 4/2018 |
| WO | WO2018/183469 | 10/2018 |
| WO | WO2019/043368 | 3/2019 |
| WO | WO2020/017883 | 1/2020 |
| WO | WO2023/017382 | 2/2023 |

OTHER PUBLICATIONS

"Impact resistance and energy absorption of functionality graded cellular structures", Wang et al., Applied Mechanics and Materials, ISSN: 1662-7482, vol. 69, pp. 73-78, Jul. 4, 2011, 7 pages.

"The design of impact absorbing structures for additive manufacture", Craddock et al., Modern Practice in Stress and Vibration Analysis 2012 (MPSVA 2012), Journal of Physics: Conference Series 382 (2012), IOP Publishing Ltd, 7 pages.

"Adaptive voids: Primal and dual adaptive cellular structures for additive manufacturing", Medeiros e Sa et al., Springer-Verlag Berlin Heidelberg 2015, May 14, 2015, 10 pages.

"Data-customized midsoles with New Balance", Nervous System Blog, Nov. 30, 2015, 7 pages.

"An Interactive Product Customization Framework for Freeform Shapes", Zhang et al., Rapid Prototyping Journal, Dec. 5, 2016, 11 pages.

"Democratising Design through Computation and Digital Fabrication", Rosenkrantz et al., pp. 48-57, 2017, 10 pages.

"Thermal-Comfort Design of Personalized Casts", Zhang et al., Session: Physical Interfaces, UIST 2017, Oct. 22-25, 2017, Québec City, Canada, pp. 243-254, 12 pages.

"Plexus Protection Gear for Skateboarders", Tuvie, 2018, 12 pages.

"Polyhedral Voronoi diagrams for additive manufacturing", Martinez et al., ACM Trans. Graph, vol. 37, No. 4, Article 129, Aug. 2018, 15 pages.

* cited by examiner

PADDING MATERIAL FOR PROTECTIVE EQUIPMENT

CROSS-REFERENCE TO RELATED PATENT APPLICATION

The present application claims the benefit of and priority to U.S. Provisional Application No. 63/617,844 filed on Jan. 5, 2024, which is incorporated herein by reference in its entirety.

BACKGROUND OF THE INVENTION

The present disclosure is directed generally to protective clothing or safety equipment for workers. The present disclosure relates specifically to protection material or padding that is used in protective clothing and/or safety equipment.

For example, safety equipment, such as knee pads, that attach to the knee of the wearer can be worn to improve comfort for the wearer and absorb trauma to the knees. The protection material provides comfort, stabilization, and is designed to reduce stress and damage to the knee of the user. Similar protection material can be designed for use with various other types of safety equipment (e.g., helmet liner for hard hats/helmets, padding for impact gloves, etc.).

SUMMARY OF THE INVENTION

One embodiment of the invention relates to a knee pad. The knee pad includes an upper support configured to couple to a leg of a user above a knee, a lower support configured to couple to the leg of the user below the knee and a shell. The shell is coupled to the upper support and the lower support and positioned between the upper support and the lower support. The knee pad further includes a single, integral padding layer. The padding layer includes an outer surface that interfaces against the shell, an inner surface, and a plurality of cells. Each of the plurality of cells extends between the outer surface and the inner surface. Each of the plurality of cells includes a channel connecting the outer surface and the inner surface, a longitudinal axis extending along the channel, and a cell wall enclosing the channel. The cell wall includes a plurality of segments angled relative the longitudinal axis.

Another embodiment of the invention relates to a knee pad. The knee pad includes an upper support, a lower support, and a shell. The shell is coupled to the upper support and the lower support and positioned between the upper support and the lower support. The knee pad further includes a single, integral padding layer. The padding layer includes an outer surface positioned along the shell, an inner surface, and a plurality of cells. Each of the plurality of cells extends between the outer surface and the inner surface. Each of the plurality of cells includes a channel connecting the outer surface the inner surface, a longitudinal axis extending along the channel, and a cell wall enclosing the channel. The cell wall includes an inward angled segment and an outward angled segment. The inward angled segment and the outward angled segment are angled relative to the longitudinal axis.

Another embodiment of the invention relates to a knee pad. The knee pad includes an upper support, a lower support, and a shell. The shell is coupled to the upper support and the lower support and positioned between the upper support and the lower support. The knee pad further includes a single, integral padding layer. The padding layer includes an outer surface positioned along the shell, an inner surface, and a plurality of cells. Each of the plurality of cells extends between the outer surface and the inner surface. Each of the plurality of cells includes a channel connecting the outer surface the inner surface, a longitudinal axis extending along the channel, and a cell wall surrounding the channel. The cell wall includes a pair of inward angled segments and a pair of outward angled segments. The pair of inward angled segments and the pair of outward angled segments are angled relative to the longitudinal axis.

Additional features and advantages will be set forth in the detailed description which follows, and will be readily apparent to those skilled in the art from the description or recognized by practicing the embodiments as described in the written description and/or shown in the accompany drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, one or more embodiments of protective clothing or safety equipment with a padding layer are described herein. Various types of safety equipment and protective clothing (e.g., knee pads, helmets, gloves, etc.) include padding to provide protection and/or support. For example, as discussed herein, various embodiments of a knee pad including a padding layer with a non-uniform stiffness and/or cellular structure are described.

In various embodiments, the padding layer may be formed from a single, integral piece of polymer material with a plurality of cells. In general, the compression/stiffness properties may be adjusted by controlling the geometry of the cells and the size of the cells. In specific embodiments, the cells of the padding layer have different sizes, dimensions, and/or shapes in different regions of the padding layer. Applicant has found these differences in structure provide for chosen compression or stiffness properties in key regions of the safety equipment. Further, Applicant has found that altering the cellular structure can create padding layers that exhibit relatively linear load deflection responses within specific regions of the padding layer. In this manner, the padding material may be designed to minimize high pressure zones (e.g., areas around the knee cap for a knee pad) and to distribute pressure across more evenly across the padding material. In a specific embodiment, the cell walls of the padding layer are formed from a material having a zig-zag cell profile with larger area cells located in central areas that correspond to the knee cap of the wearer. Further, as will be described in greater detail below a method of manufacturing padding layers for protective layers is discussed herein.

Figure 1:
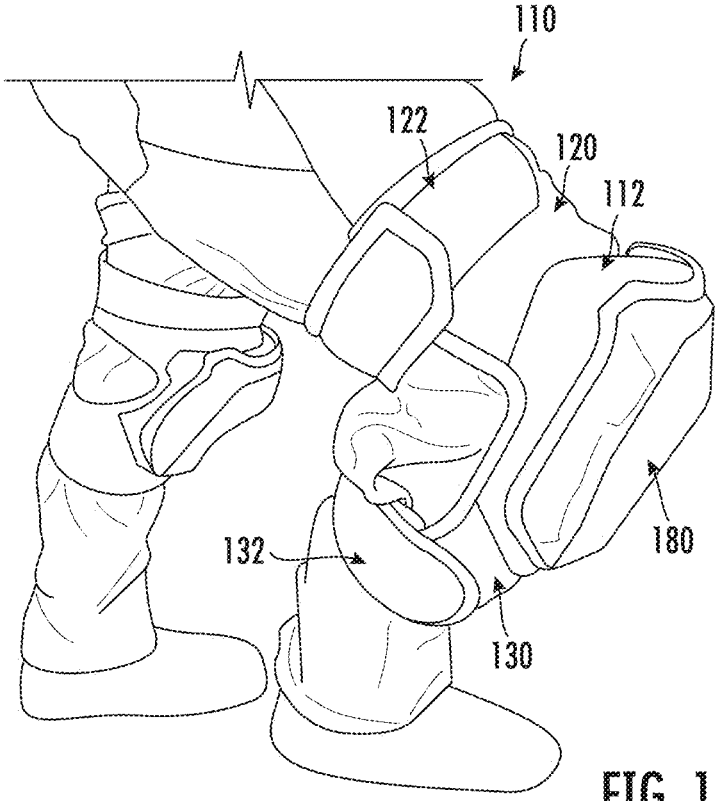
FIG. 1 is a perspective view of a knee pad, according to an exemplary embodiment.
Figure 2:
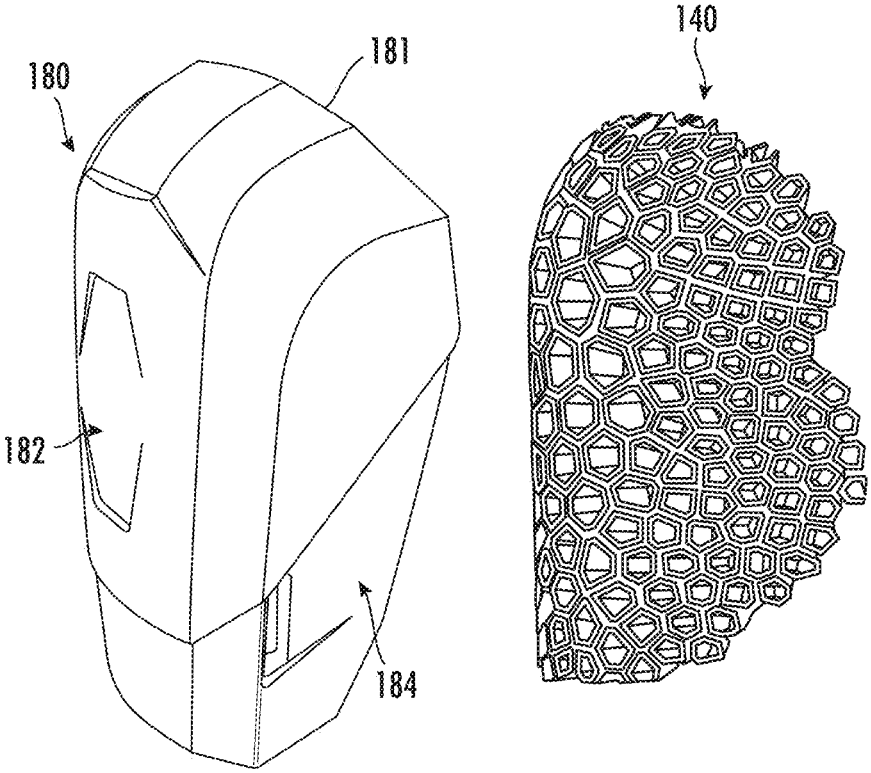
FIG. 2 is an exploded view of a portion of the knee pad of FIG. 1, according to an exemplary embodiment.
Figure 3:
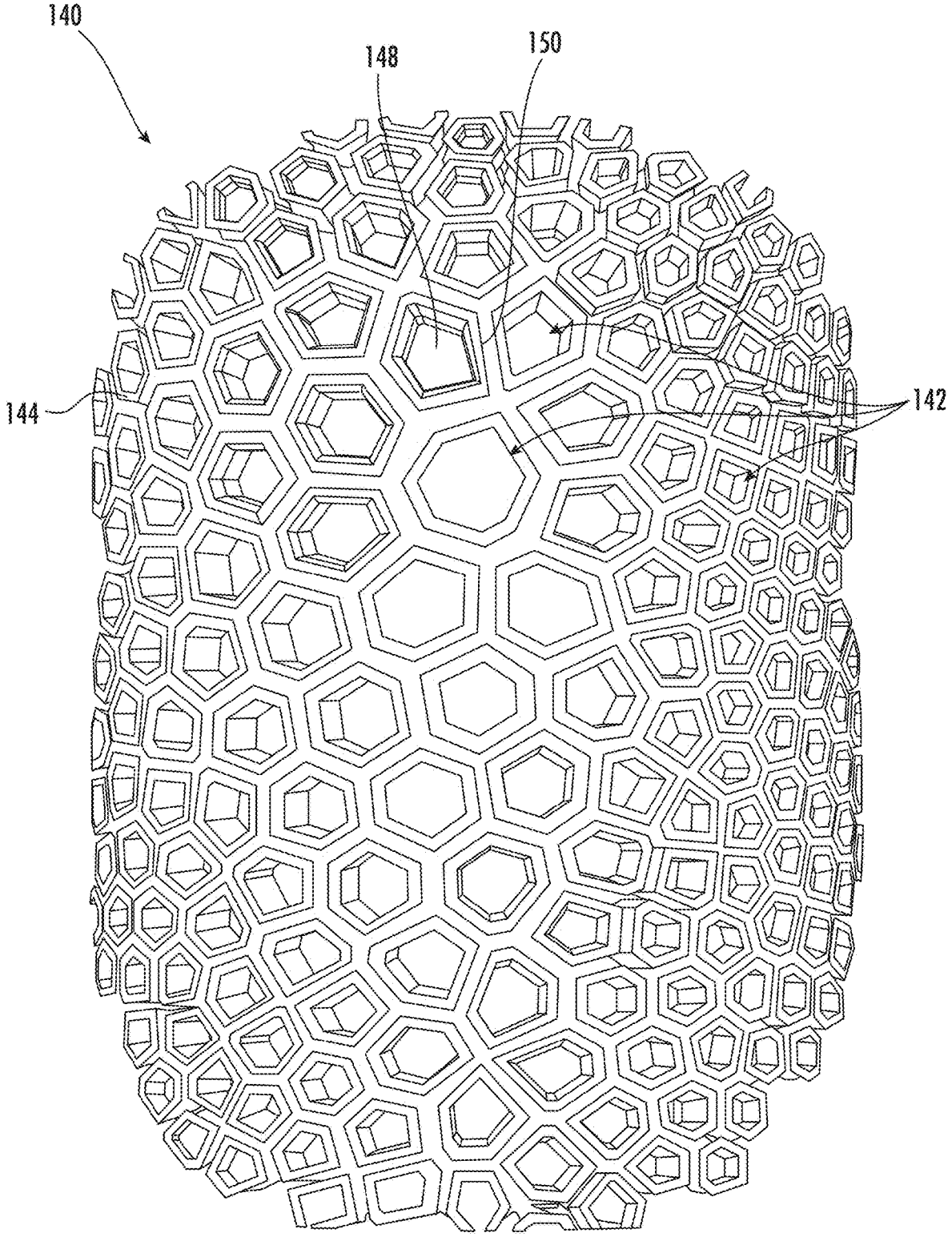
FIG. 3 is a front perspective view of a padding layer of the knee pad of FIG. 1, according to an exemplary embodiment.
Figure 4:
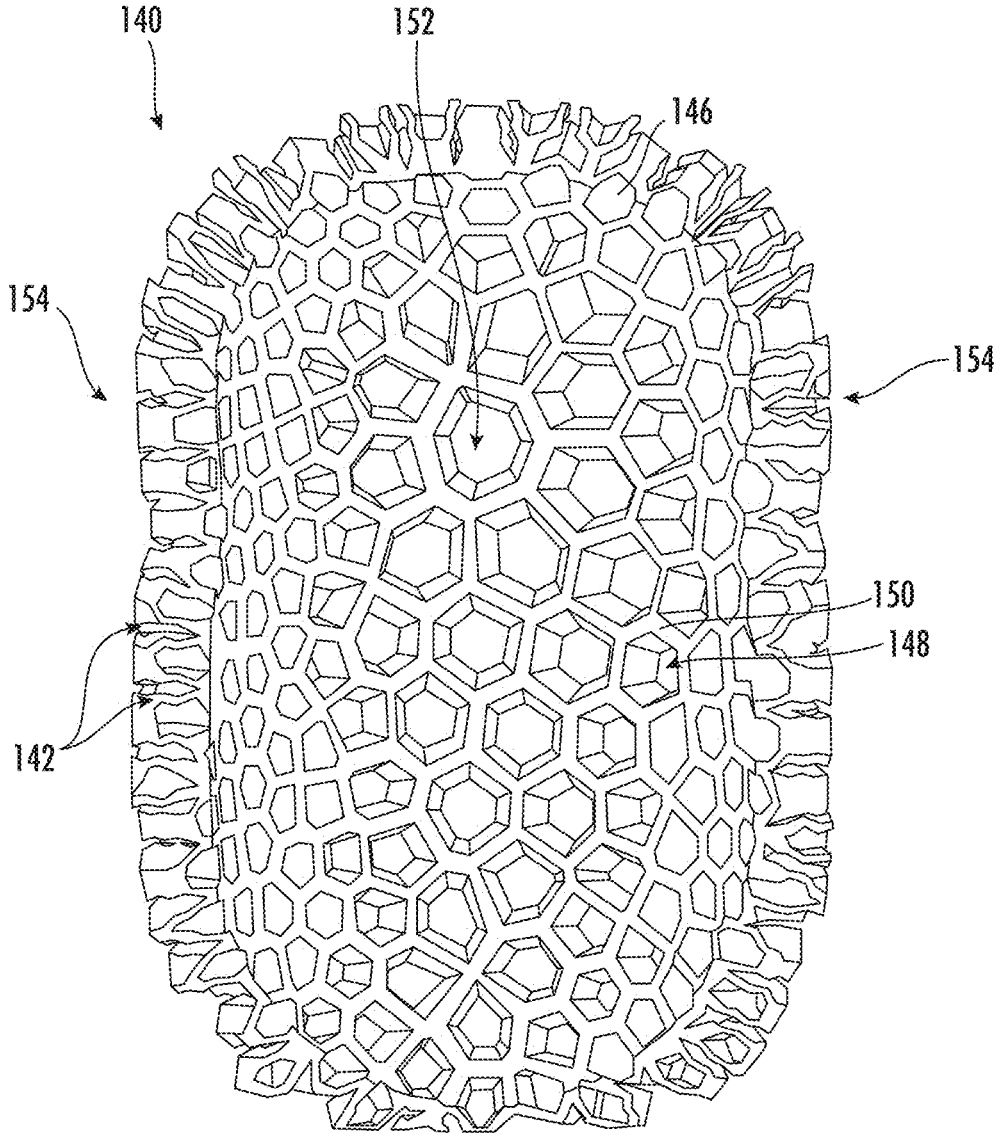
FIG. 4 is a rear perspective view of the padding layer of FIG. 3, according to an exemplary embodiment.
Figure 5:
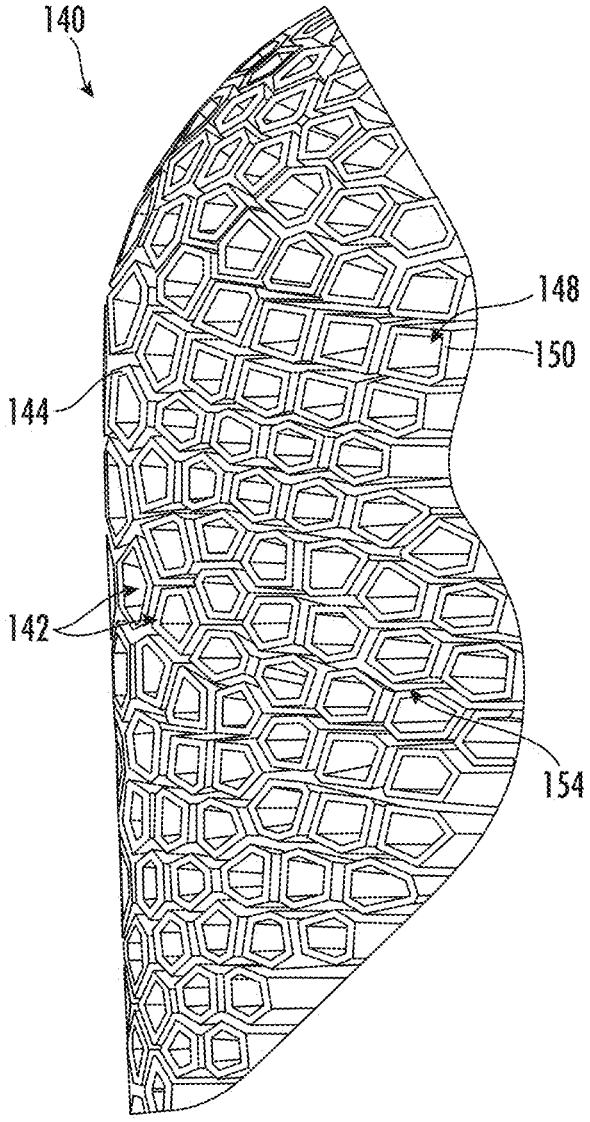
FIG. 5 is a side view of the padding layer of FIG. 3, according to an exemplary embodiment.
Figure 6:
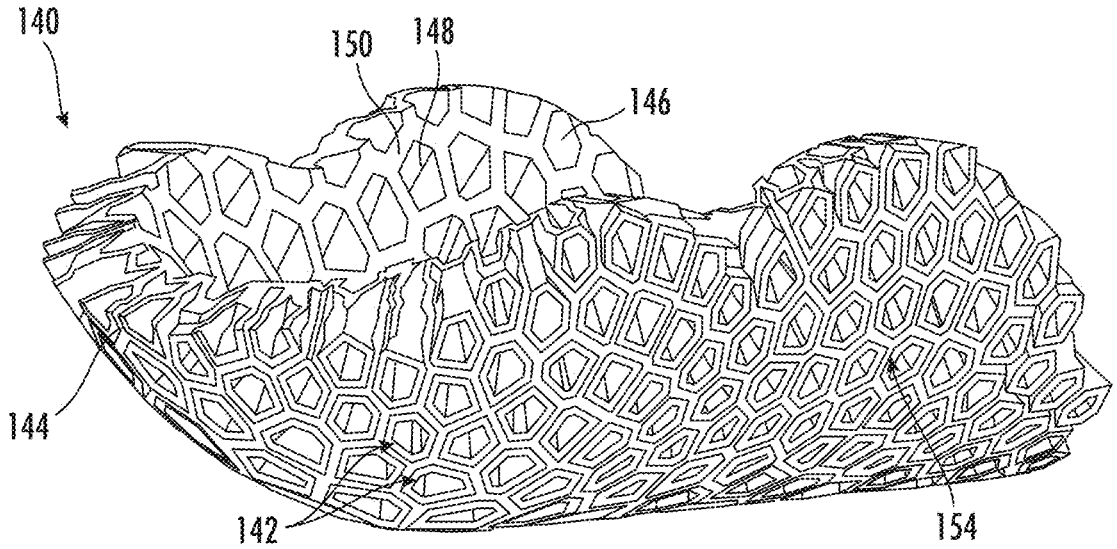
FIG. 6 is a top, front perspective view of the padding layer of FIG. 3, according to an exemplary embodiment.
Figure 7:
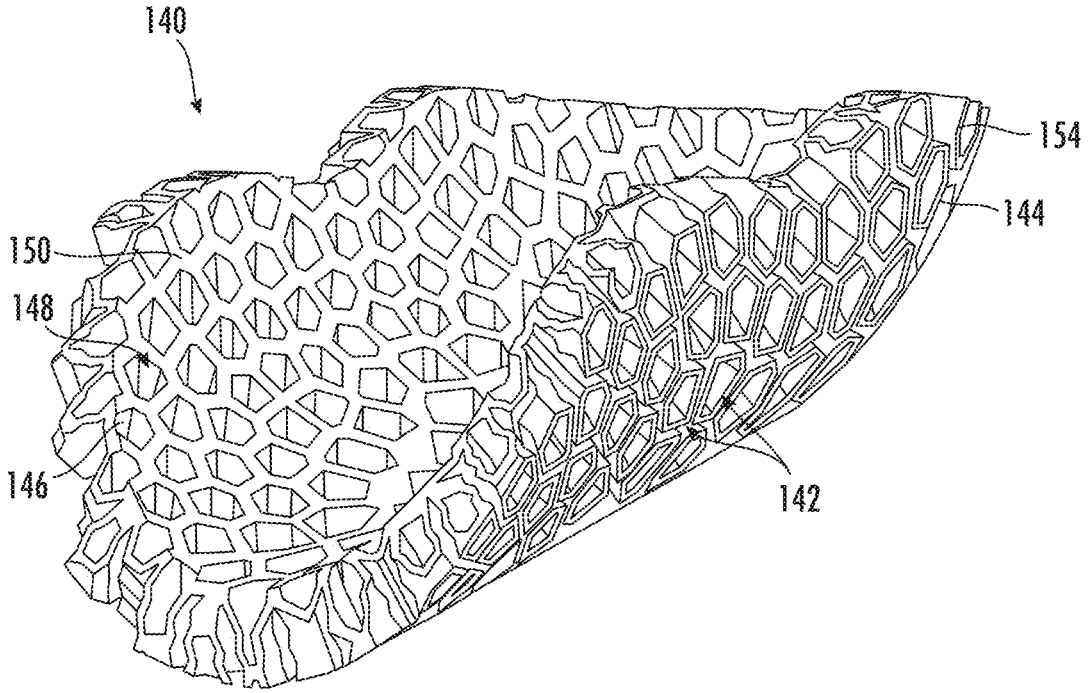
FIG. 7 is a bottom, rear top, perspective view of the padding layer of FIG. 3, according to an exemplary embodiment.
Figure 8:
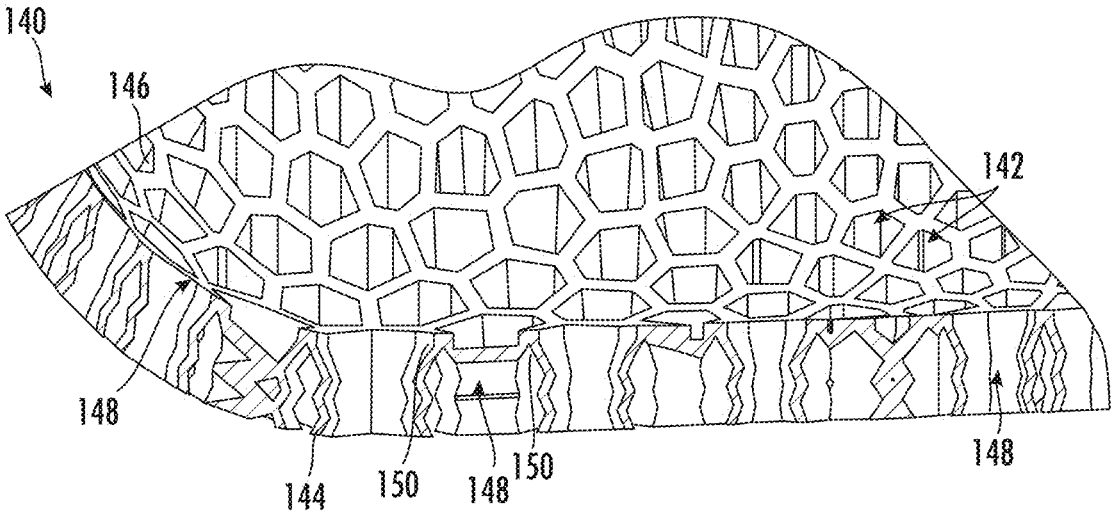
FIG. 8 is a cross-sectional view of the padding layer of FIG. 3, according to an exemplary embodiment.

Referring to FIGS. 1-2, various aspects of a piece of protective equipment for protecting and/or supporting knees of users, shown as knee pad 110, are shown. Knee pad 110 includes shell 180. In various embodiments, shell 180 is coupled to upper support 120 and lower support 130 via gasket 112. Upper support 120 is configured to couple to a leg of a user above a knee, such as via strap 122 that wraps around the leg of the user. Lower support 130 is configured to couple to the leg of the user below the knee, such as via strap 132. The shell 180 is coupled to the upper support 120 and the lower support 130 and extends between the upper support 120 and the lower support 130. Shell 180 is formed from a first material, such as a flexible and durable polymer material. Shell 180 is formed from a material that has a higher durometer than padding layer 140.

Knee pad 110 includes padding layer 140 coupled to an interior surface 181 of shell 180. In various embodiments, padding layer is coupled to shell 180 by fasteners, protrusions, etc. Padding layer 140 is coupled to shell 180 between the interior surface 181 of shell 180 and the knee of the user. In various embodiments, padding layer 140 extends from one lateral wall 184 to the opposing lateral wall 184 such that padding layer 140 is adjacent to and/or coupled to front wall 182 between the lateral walls 184. Lateral walls 184 extend from opposing sides of front wall 182 of shell 180. In other words, a first lateral wall 184 extends rearward, away from a first side of the front wall 182 and a second lateral wall 184 extends rearward from a second side of the front wall 182 opposing the first side of the front wall 182. In various specific embodiments, the lateral walls 184 extend past or beyond an anterior or rear edge of the padding layer 140 such that each one of the lateral walls 184 provides a supporting force against a side (medial and lateral sides) of the knee when a user is kneeling. In various embodiments, the supporting force is applied inward, against a side of the knee when the user is kneeling.

In various embodiments, padding layer 140 is formed from a single, integral piece of polymer material. In a specific embodiment, padding layer 140 is formed from a thermoplastic elastomer. In various embodiment, padding layer 140 has a cellular structure. In such embodiments, padding layer 140 has different sized cells at different locations to provide different compression/stiffness properties at chosen locations or portions of the padding based on the expected loading of the padding in those locations or regions of the knee pad 110. As will be discussed in greater detail below, in various embodiments the padding layer 140 is designed such that the padding layer 140 exhibits relatively linear load deflection responses within locations or regions. Applicant believes such a design minimizes high pressure zones (e.g., areas around the knee cap) and distribute pressure across more evenly across the padding layer 140.

Referring to FIGS. 3-8, various views of padding layer 140 are shown. Padding layer 140 includes a plurality of cells 142. Padding layer 140 includes an outer surface 144 that is positioned within and/or coupled to shell 180 and an inner surface 146 that faces the knee of the user. Each of the cells 142 extends between the outer surface 144 and the inner surface 146. The cells 142 include a channel 148 extending between and connecting the outer surface 144 and the inner surface 146 of the padding layer. Each channel 148 is surrounded or enclosed by a cell wall 150.

In various embodiments, padding layer 140 is made of a material that allows padding layer 140 to be a reduced thickness compared to other padding structures for knee pads (e.g., foam padding, etc.). In various embodiments, the padding layer 140 has a thickness less than a maximum thickness of 40 mm. In specific embodiments, padding layer has a thickness less than 35 mm, specifically less than 30 mm and more specifically less than 25 mm. In a specific embodiment, padding layer 140 has a thickness of 19 mm.

In various embodiments, the cells 142 of the padding layer 140 have a non-uniform size. In other words, the dimensions of the cells 142 are different in various locations within the padding layer 140. As will be discussed in greater detail below, the size of the cells 142 is determined by a packing algorithm. In various embodiments, the cell 142 size of padding layer 140 in the central section 152 is greater than the cell 142 size in the side sections 154. The central section 152 of the padding layer 140 is positioned against and/or adjacent the front 182 wall of shell 180 when knee pad 110 is assembled. The side sections 154 of padding layer 140 are positioned against and/or adjacent to lateral walls 184 of shell 180 when knee pad 110 is assembled.

Figure 9:
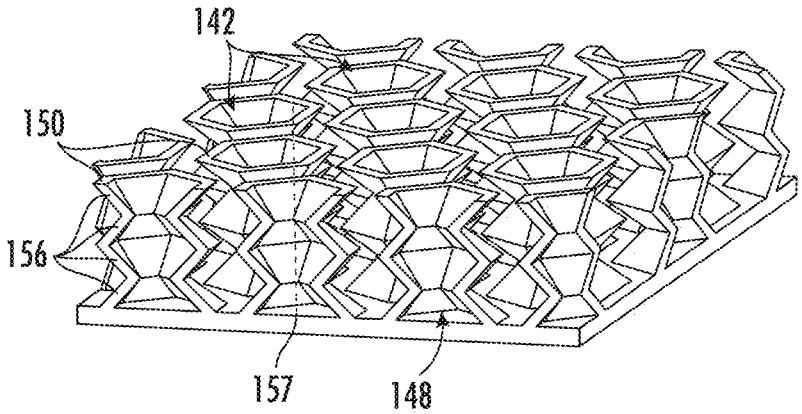
FIG. 9 is a perspective view of the cells of a padding layer, according to an exemplary embodiment.
Figure 10:
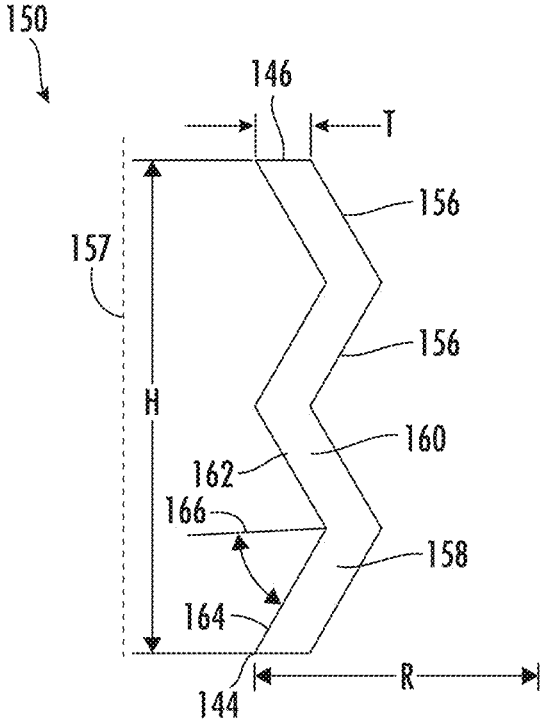
FIG. 10 is a side view of a cell of FIG. 9, according to an exemplary embodiment.

Referring to FIGS. 9-10, detailed views of the cell 142 shape and/or dimensions are shown according to an exemplary embodiment. Each cell 142 includes cell walls 150 with a plurality of wall segments 156. In a specific embodiment, the plurality of wall segments 156 are angled relative to a longitudinal axis 157 of the cell 142 and/or channel 148. In specific embodiments, a dimension of the cell 142 is defined by the size of the channel 148. In specific embodiments, a dimension of the cell 142 is defined by the cell walls 150.

In various embodiments, a portion of the wall segments 156 are walls angled inward 158 (i.e., toward channel 148 and opposing cell wall 150) and a portion of the wall segments 156 are walls angled outward 160 (i.e., away from channel 148 and opposing cell wall 150). In a specific embodiment, each cell 142 has four wall segments 156 including two walls angled inward 158 and two walls angled outward 160. In other embodiments, the number of wall segments 156 is different (e.g., 3, 5, 6, etc.). Each wall angled inward 158 has an inner surface 164 facing the channel 148 and each wall angled outward 160 has an inner surface 162 facing channel 148. In a specific embodiment, the wall angled inward 158 and specifically inner surface 164 is at about a 30 degree angle (e.g., 30 degrees plus or minus 10 degrees) relative to an axial axis 166 of cell 142.

In a specific embodiment, the cell wall 150 has a thickness, T, of 2 mm. In a specific embodiment, cell 142 has a height, H, Defined between the outer surface 144 and the inner surface 146. In a specific embodiment, H is about 17.5 mm (e.g., 17.5 mm plus or minus 5 mm). Cell 142 has an effective radius defined as a distance from the center of the cell to the cell wall 150. In a specific embodiment, cell 142 has an effective radius R of 10 mm.

Figure 11:
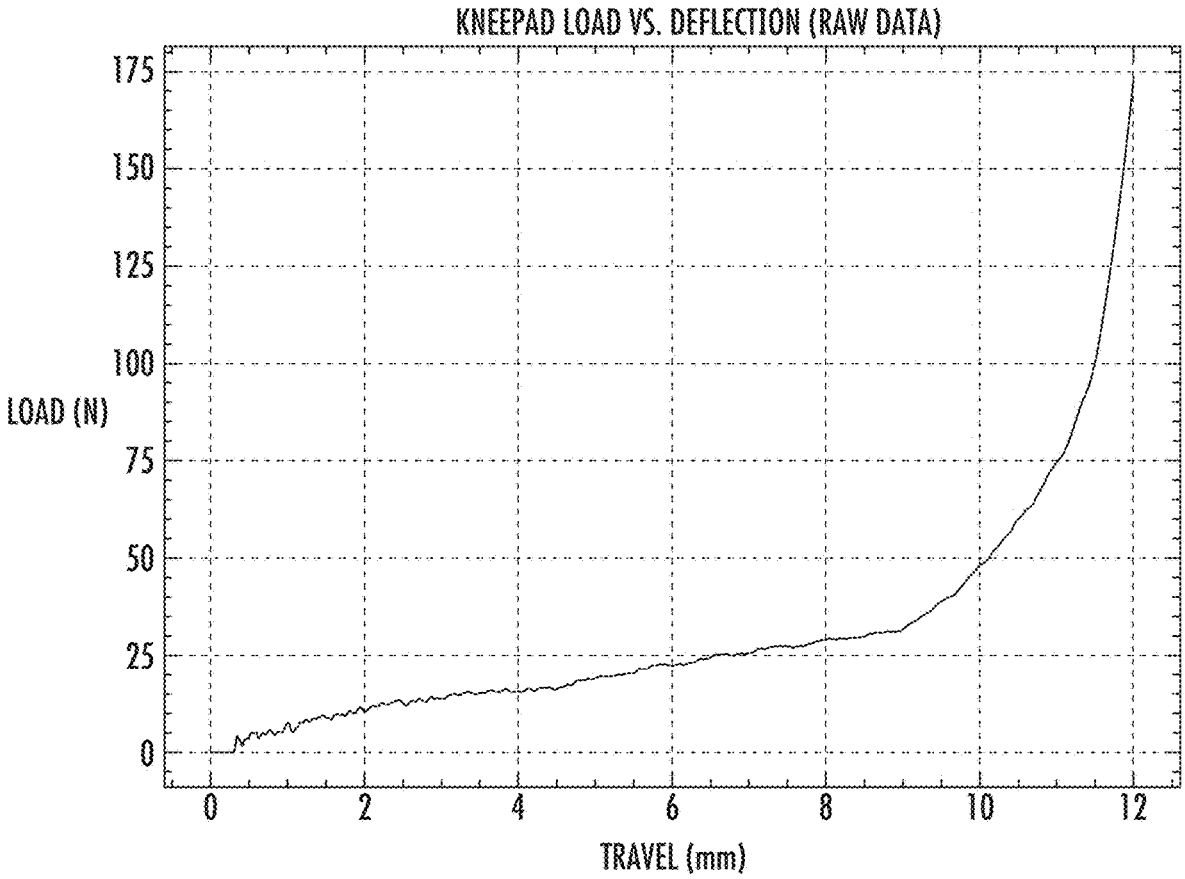
FIG. 11 is a plot showing the load on the padding layer relative to deflection, according to an exemplary embodiment.

Referring to FIG. 11, a plot showing the load on the padding layer 140 relative to a deflection, is shown according to an exemplary embodiment. Applicant has found, the padding layer 140 exhibits relatively linear load deflection responses within the different areas of the padding layer 140.

Figure 12:
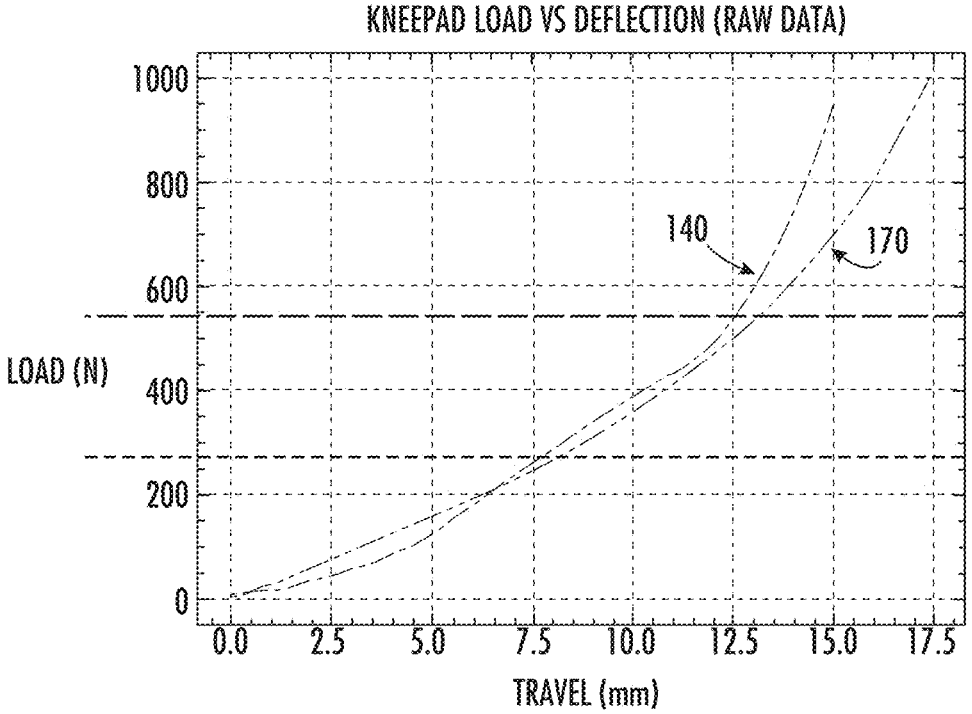
FIG. 12 is a plot showing the load on the padding layer relative to deflection compared to a prior art knee pad, according to an exemplary embodiment.

Referring to FIG. 12, a plot showing the load on the padding layer 140 relative to a deflection compared to a commercially available knee pad 170 (Milwaukee Tool Performance Knee Pad (48-73-6040)), is shown according to an exemplary embodiment. The padding layer 140 tested has a thickness of 19 mm and the prior art knee pad 170 has a thickness of 32 mm. As can be seen, the results are similar up to about 500 N or 12.5 mm of deflection despite the padding layer being notable thinner.

Figure 13:
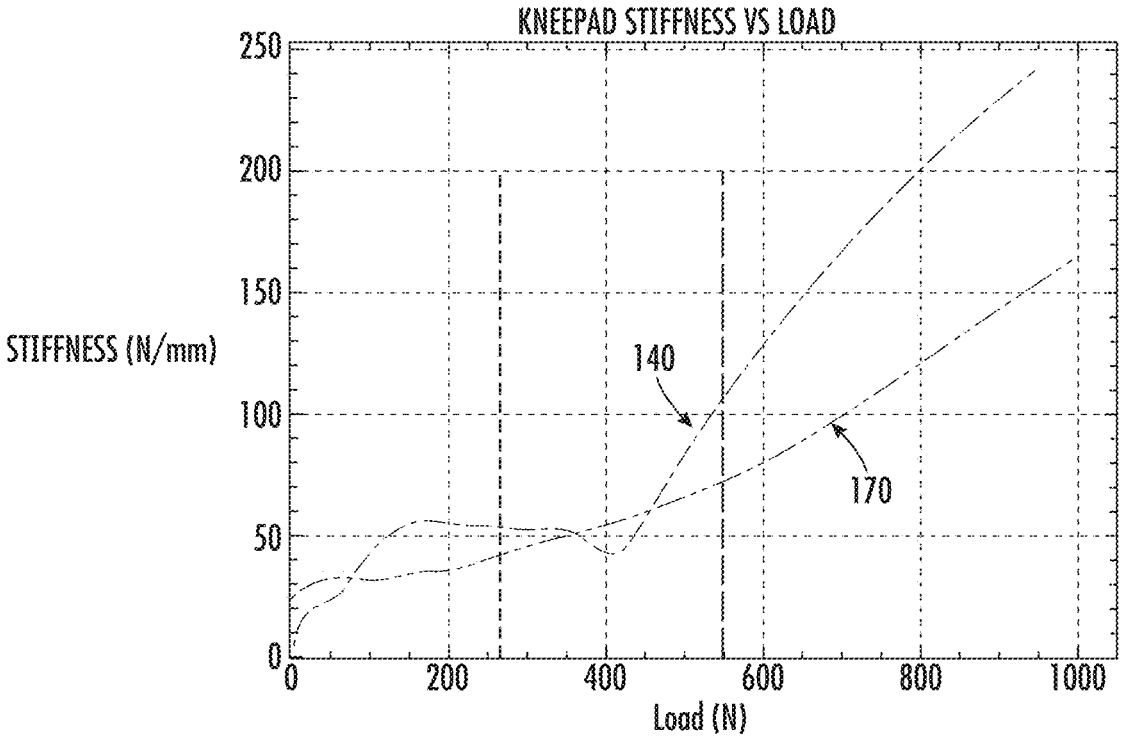
FIG. 13 is a plot showing the stiffness of the padding layer relative to a load compared to a prior art knee pad, according to an exemplary embodiment.

Referring to FIG. 13, a plot showing the stiffness of the padding layer 140 relative to a load compared to the commercially available knee pad 170, is shown according to an exemplary embodiment. The padding layer 140 tested has a thickness of 19 mm and the prior art knee pad 170 has a thickness of 32 mm. As shown in the plot of FIG. 13, padding layer 140 stiffness has a generally linear behavior up to about 500 N. The generally horizontal or plateaued portion of the data for padding layer 140 that occurs around a load of 80 represents an ideal design.

Figure 14:
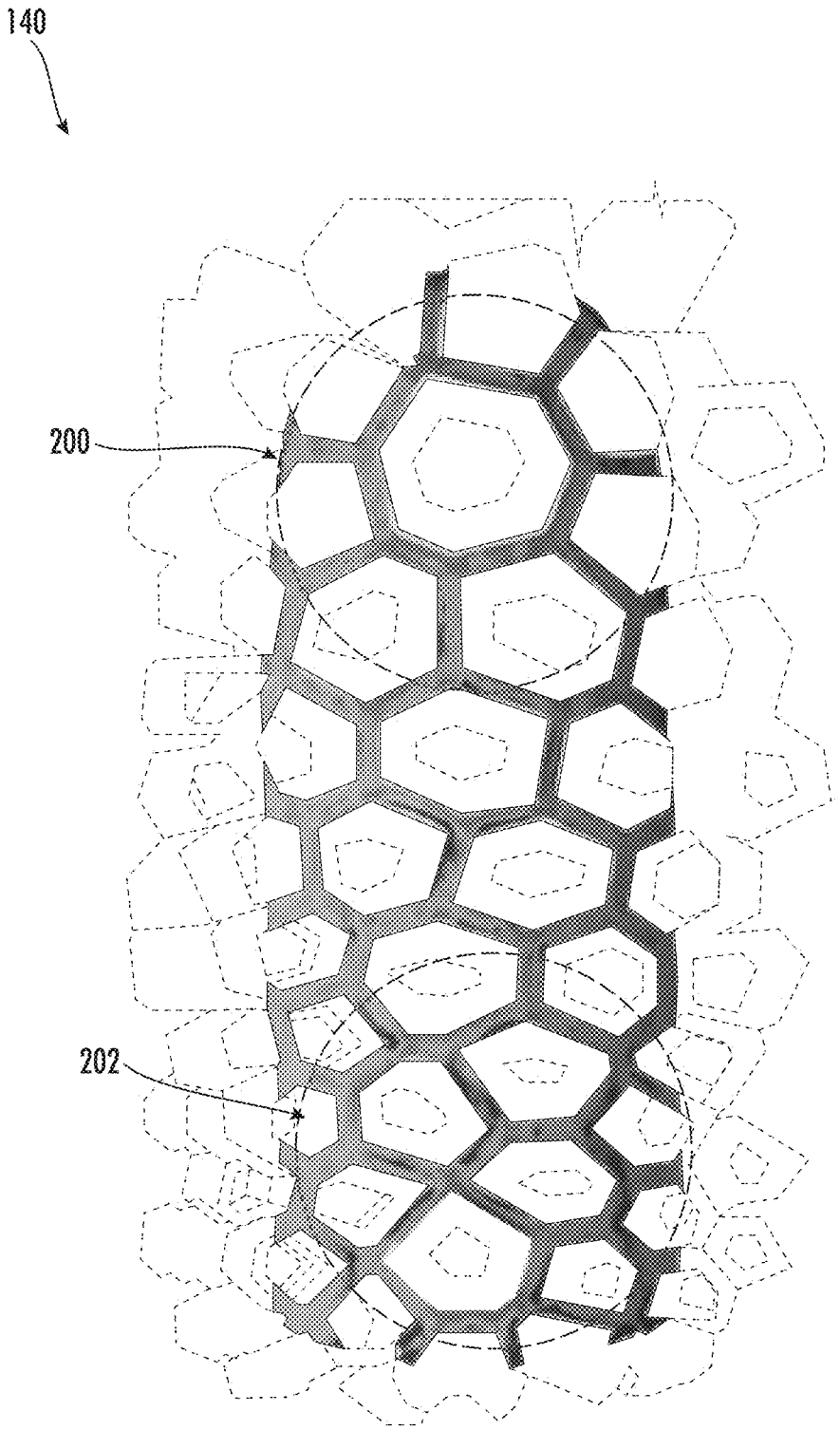
FIG. 14 is a pressure map of the padding layer, according to an exemplary embodiment.

Referring to FIG. 14, a pressure map that shows pressure when a user was kneeling on padding layer 140 is shown. In a first region 200 of the pressure map, the colors indicate a reduction in the pressure. The first region 200 corresponds generally to the knee cap or patella of the user kneeling. In a specific embodiment, the first region 200 is generally circular in shape. In a second region 202, the colors indicate an increase in pressure. The second region 202 corresponds generally to the area surrounding the knee cap of the user kneeling. In a specific embodiment, the second region 202 is generally circular in shape.

Figure 15:
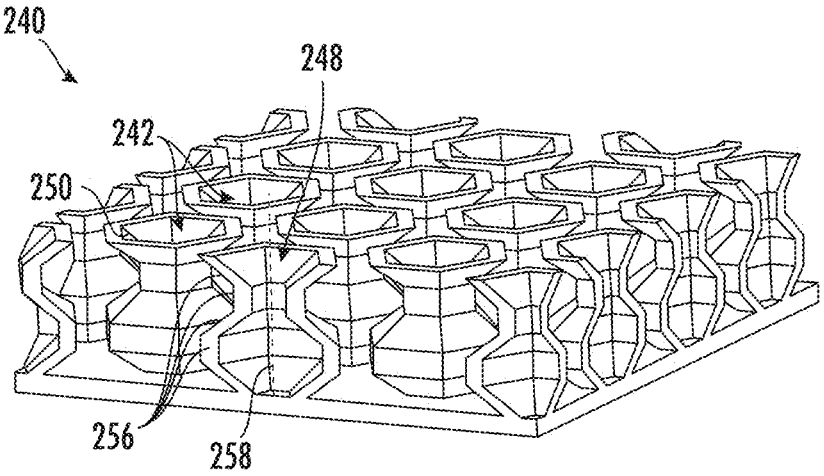
FIG. 15 is a perspective view of the cells of a padding layer, according to another exemplary embodiment.

Referring to FIG. 15, a detailed views of the cells 242 of a padding layer 240 are shown according to another exemplary embodiment. Padding layer 240 can be utilized with knee pad 110 and is substantially the same as padding layer 140 except for the differences discussed herein. Each cell 242 includes cell walls 250 with a plurality of wall segments 256. In a specific embodiment, the plurality of wall segments 156 are both angled relative to a longitudinal axis 258 of the cell 242 and/or channel 248 and parallel to longitudinal axis 258. In other words, some of the wall segments 256 are angled and some of the wall segments are generally vertical.

Figure 16:
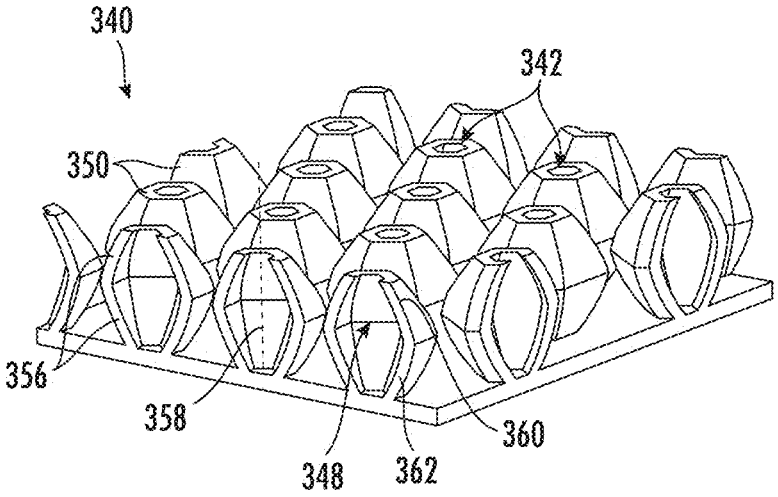
FIG. 16 is a perspective view of the cells of a padding layer, according to another exemplary embodiment.

Referring to FIG. 16, a detailed views of the cells 342 of a padding layer 340 are shown according to another exemplary embodiment. Padding layer 340 can be utilized with knee pad 110 and is substantially the same as padding layer 140 except for the differences discussed herein. Each cell 342 includes cell walls 350 with a plurality of wall segments 356. In a specific embodiment, the plurality of wall segments 256 include an upper curved portion 360 and a lower curved portion 362. Both upper curved portion 360 and lower curved portion 362 are curved inward or concave relative to channel 348.

Figure 17:
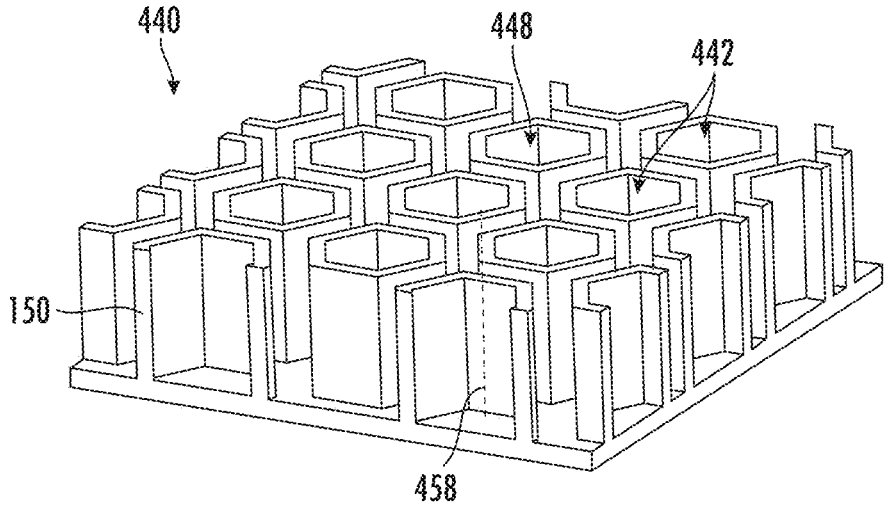
FIG. 17 is a perspective view of the cells of a padding layer, according to another exemplary embodiment.

Referring to FIG. 17, a detailed views of the cells 442 of a padding layer 440 are shown according to another exemplary embodiment. Padding layer 440 can be utilized with knee pad 110 and is substantially the same as padding layer 140 except for the differences discussed herein. Each cell 442 includes cell walls 450. In a specific embodiment, the plurality of walls 450 form a generally hexagonal shape. In other words, channel 448 is shaped like a hexagonal prism.

Referring to FIGS. 18-21, details of a method 500 of manufacturing a padding layer for protective equipment, such as padding layer 140 are shown. In a first step, a geometry is defined. The geometry 502 of the illustrated embodiment is shown as the black outer area. The geometry can be defined using a program such as CAD, a graphics program, a presentation program, etc.

In a second step, a user input such as a smoothed pressure map 504 of a knee pressure taken of an individual kneeling. In other embodiments, the user input can be based on other user data (e.g., scan), position of bones, known impact points, etc. Pressure map 504 is customizable. In the illustrated embodiment, colors or gray scale are sued to define different zones. Pressure map 504 includes a first, outer zone 506, a second zone 508, a third zone 510, a fourth zone 512, and a middle or central zone 514. A border 516 is defined between second zone 508 and first outer zone 506. Cells formed to the left of border 516 will have a smaller size and/or dimension that the cells formed to the right of the border 516.

Figure 18:
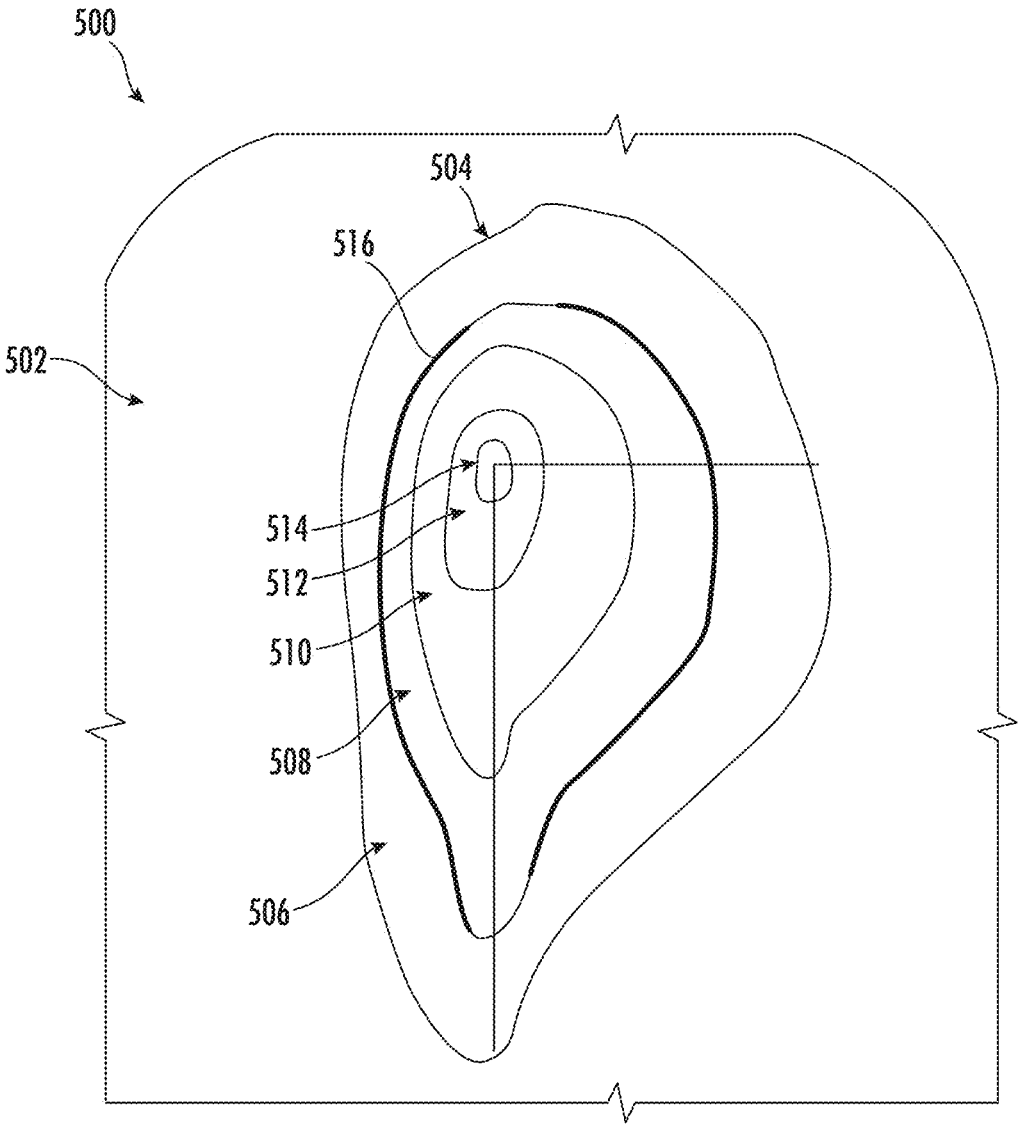
FIG. 18 is a smoothed pressure map of a knee pressure, according to an exemplary embodiment.
Figure 19:
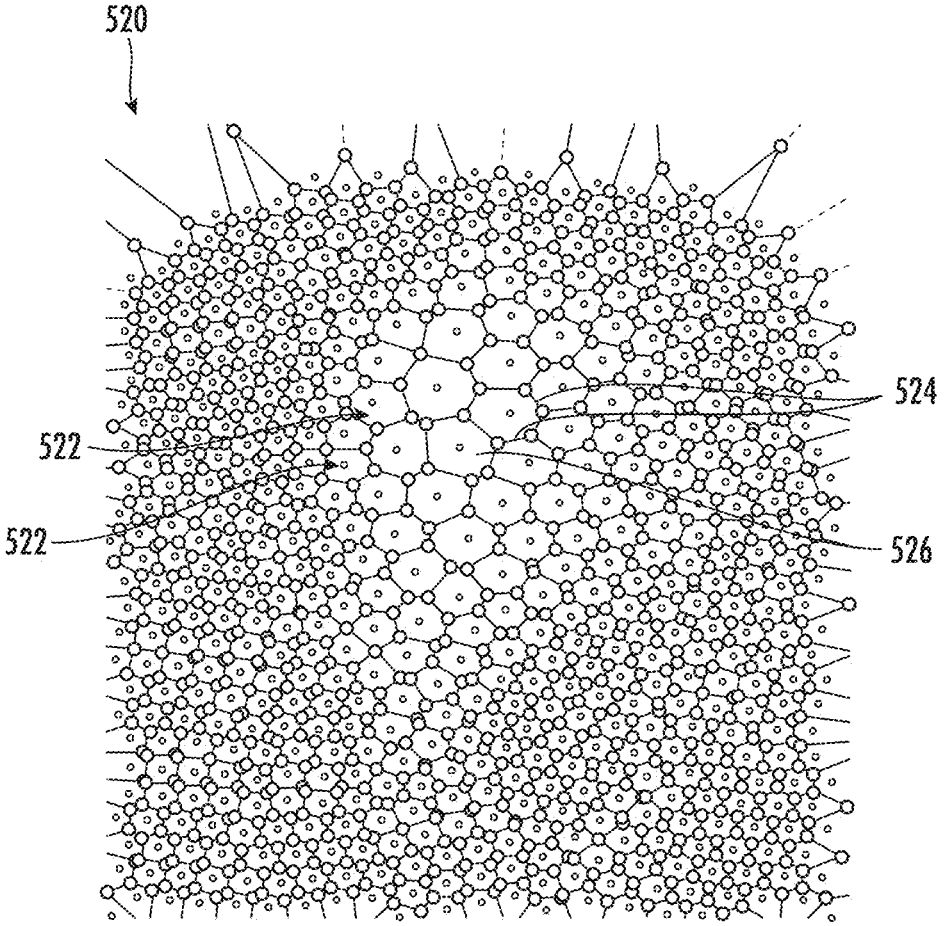
FIG. 19 is the cell map based on the pressure map of FIG. 18 after undergoing a packing algorithm.

In a third step, an algorithm is used to convert the pressure map 504 into a defined map or group 520 of a plurality of cells. In a specific embodiment, a Flat Voronoi packing algorithm is used with the pressure map of FIG. 18 is used to create a plurality of cells 522 as shown in FIG. 19. As will be generally understood, the algorithm determines the size and/or dimensions of each cell 522 including the number of walls 524. The walls 524 of cells 522 are shown in black and a center 526 of each cell is indicated by the dot positioned within each group of cell walls 524. In various other embodiments, a different algorithm or method can be used to create a plurality of cells for a padding layer. For example, tessellation with a chosen shape (e.g., hexagon, square, etc.) can be used.

Figure 20:
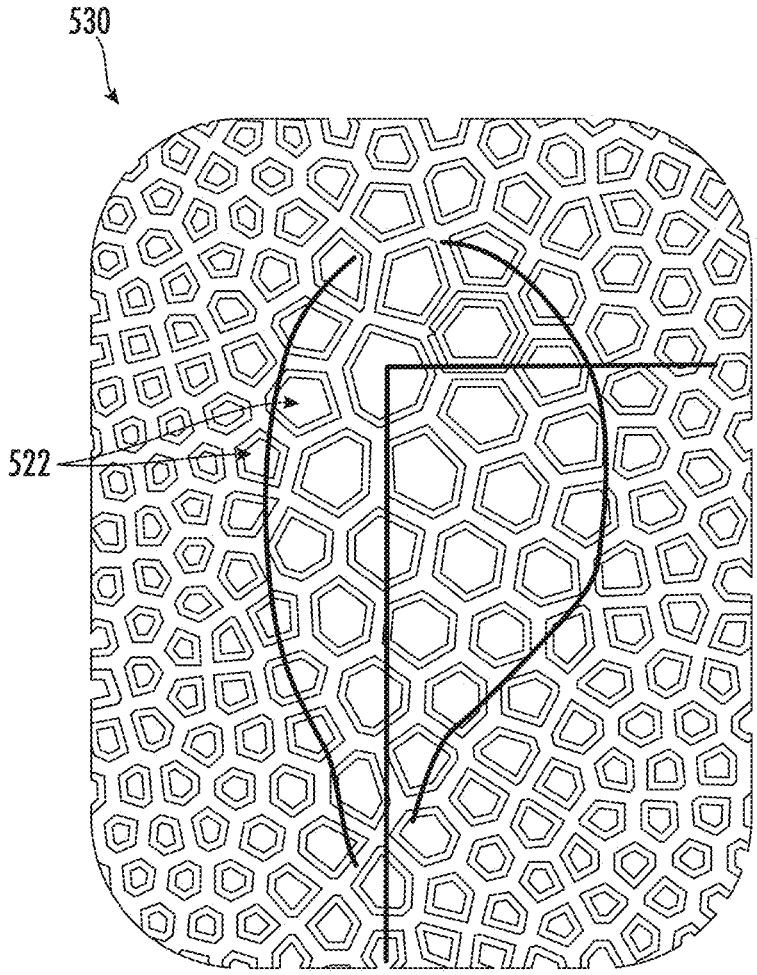
FIG. 20 is a plan view of packed cells formed based on the pressure map of FIG. 18, according to an exemplary embodiment.
Figure 21:
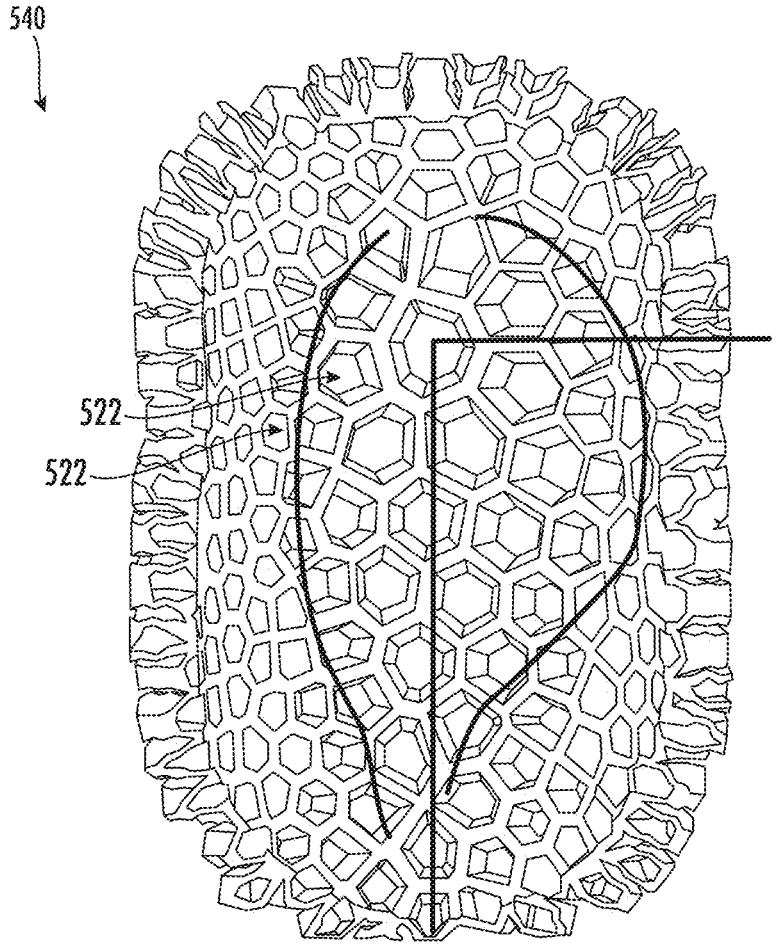
FIG. 21 is a three dimensional padding layer formed based on the packed cells of FIG. 17, according to an exemplary embodiment.

In a fourth step, the geometry of the wall 524 is chosen. For example, an angled or zig-zag wall (see e.g., FIG. 10) can be used. In various embodiments a space is inserted between adjacent cells 522 to avoid overlap. As shown in FIG. 20, in a fifth step a 3-dimensional model 530 of the map 520 of cells is created. In a specific embodiment, a computer aided design or CAD program is used. In a sixth step, the 3-dimensional model 530 is used to create a curved 3-dimensional padding layer 540. In a specific embodiment, the padding layer 540 is molded in a curved shape. Applicant believes there are numerous advantages to using a curved molding process. In contrast to flat molding that may pucker, crease, kink when curving the flatly molded cells, the curved molding process allows plurality of cells 522 maintain the desired structure (see e.g., FIG. 8). The curved three-dimensional padding layer 540 can then be used with a knee pad shell to complete a knee pad, such as knee pad 110. In other embodiments, a different method is used to create the three-dimensional padding layer such as additive manufacturing (e.g., 3D printing, etc.).

Figure 22:
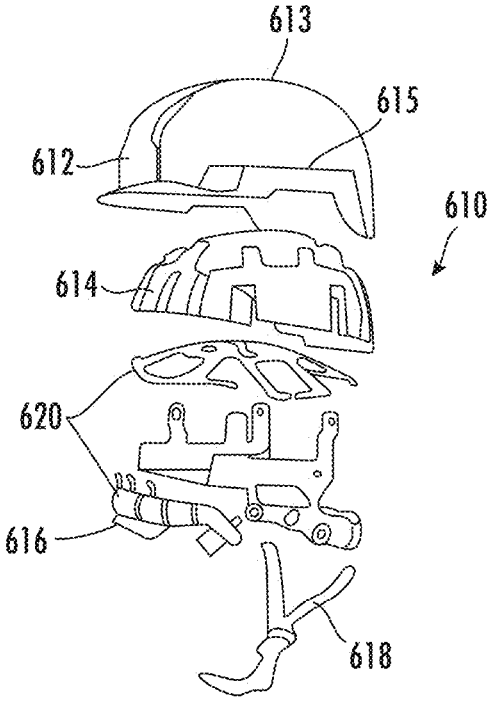
FIG. 22 is an exploded view of a hard hat, according to an exemplary embodiment.

Referring to FIG. 22, an exploded view of a hard hat 610 is shown according to an exemplary embodiment. Hard hat 610 includes an outer shell 612 formed from a rigid material, such as a rigid polymer material. Outer shell 612 includes a crown portion 613 and a bottom or brim portion 615 defining a lower circumference of hard hat 610. Hard hat 610 includes a padding layer 614 supported within outer shell 612. Hard hat 610 includes a suspension system 616 and a chin strap 618 to support and secure hard hat 610 to a user's head. In specific embodiments, hard hat 610 also includes various layers of padding 620 to provide increased comfort to the wearer.

Figure 23:
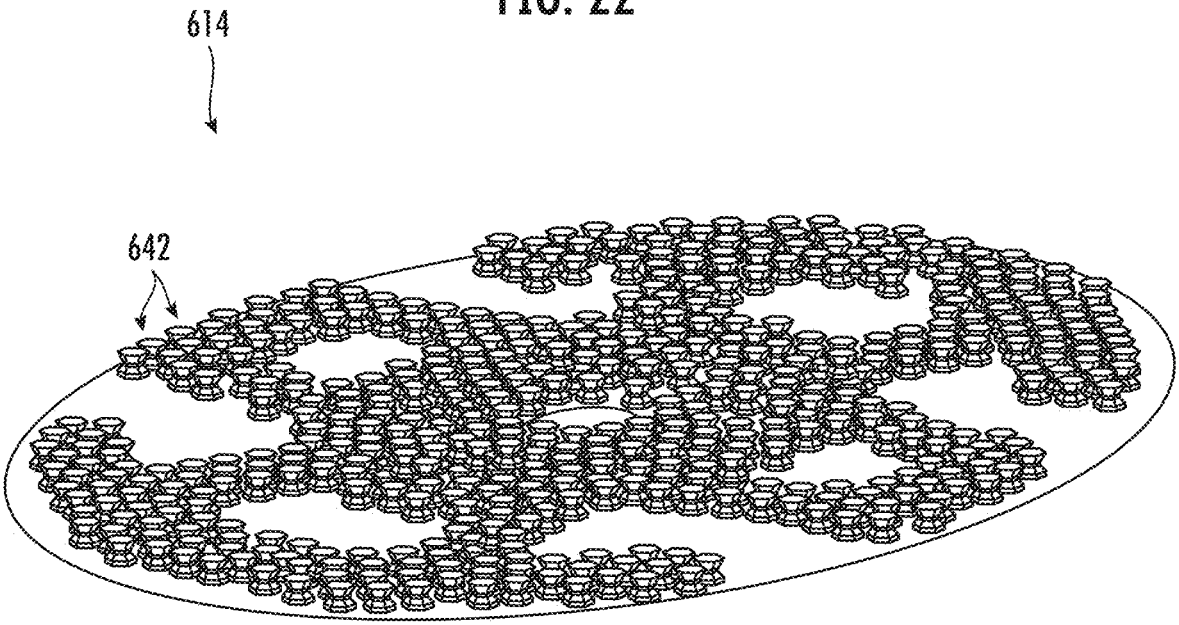
FIG. 23 is a perspective view of a padding layer of the hard hat of FIG. 22, according to an exemplary embodiment.

Referring to FIG. 23, a perspective view of a padding layer 614 is shown according to an exemplary embodiment. Padding layer 614 includes a plurality of cells 642 have a size and/or dimension chosen to reduce pressure on the head of a user wearing helmet 610.

Figure 24:
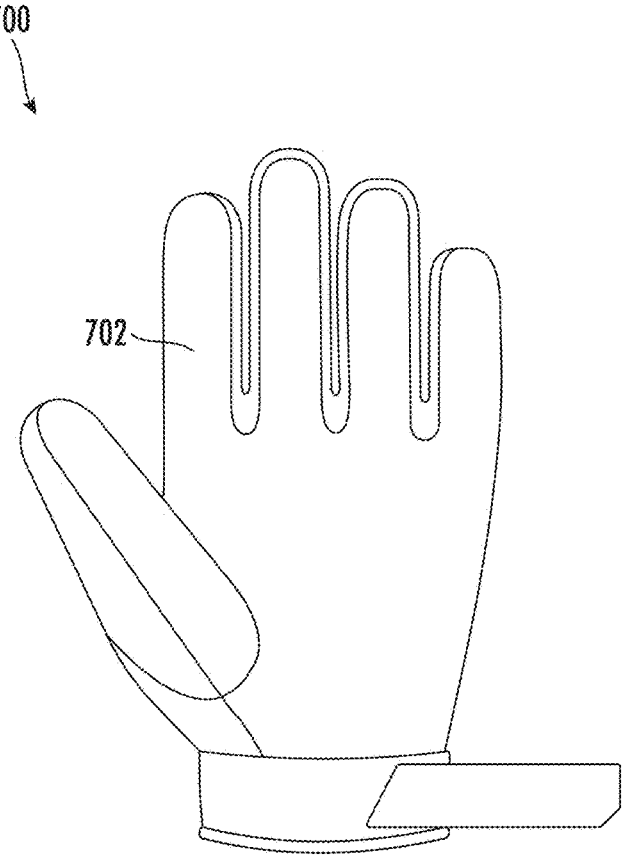
FIG. 24 is an impact protection glove, according to an exemplary embodiment.

Referring to FIG. 24, a glove, shown as an impact protection glove 700 is shown according to an exemplary embodiment. Glove 700 includes an outer surface or cover 702 that surrounds and encloses a padding layer 714 (see e.g., FIG. 25).

Figure 25:
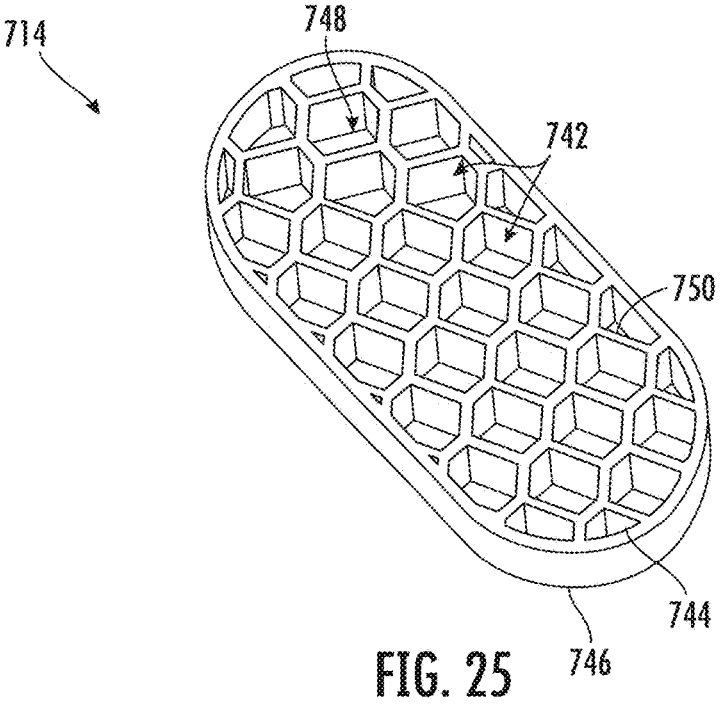
FIG. 25 is a padding layer of the impact protection glove of FIG. 24, according to an exemplary embodiment.

Referring to FIG. 25, details of padding layer 714 are shown, according to an exemplary embodiment. Padding layer 714 includes a plurality of cells 742 with channels 748 extending between and connecting the outer surface 744 and the inner surface 746 of the padding layer 714. Each channel 748 is surrounded or enclosed by a cell wall 750.

The method 500 of manufacturing a padding layer for protective equipment can similarly be used for padding layer 614 and 714. Further, the method can be used for additional types of protective equipment and/or layers such as elbow guards, padded sleeves, shoe insoles, shoe outsoles, etc. As will be generally understood, different types of protective equipment will each have their own design target or geometry 502.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature. As used herein, "rigidly coupled" refers to two components being coupled in a manner such that the components move together in a fixed positional relationship when acted upon by a force.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed:

1. A knee pad comprising:

an upper support configured to couple to a leg of a user above a knee;

a lower support configured to couple to the leg of the user below the knee;

a shell coupled to the upper support and the lower support and positioned between the upper support and the lower support; and a single, integral padding layer comprising:

an outer surface interfacing against the shell;

an inner surface; and a plurality of cells, each of the plurality of cells extending between the outer surface and the inner surface, each of the plurality of cells comprising:

a channel connecting the outer surface and the inner surface;

a longitudinal axis extending along the channel between the outer surface and the inner surface; and a cell wall enclosing the channel, the cell wall comprising a plurality of segments angled relative to the longitudinal axis and positioned along a height of the cell wall.

2. The knee pad of claim 1, wherein a portion of plurality of segments are angled inward, toward a center of the channel and a portion of the plurality of segments are angled outward, away from the center of the channel.

3. The knee pad of claim 2, wherein half of the plurality of segments are angled inward and half of the plurality of segments are angled outward.

4. The knee pad of claim 1, wherein a thickness of the padding layer is defined between the outer surface and the inner surface, and wherein the thickness is less than 40 mm.

5. The knee pad of claim 4, wherein the thickness is less than 25 mm.

6. The knee pad of claim 1, wherein the shell further comprises:

a front wall; and a pair of lateral walls, each lateral wall extending from an opposing side of the front wall.

7. The knee pad of claim 6, wherein the padding layer further comprises:

a central section positioned against the front wall of the shell; and side sections positioned against the pair of lateral walls of the shell.

8. The knee pad of claim 7, wherein the plurality of cells in the central section have a first dimension and the plurality of cells in the side sections have a second dimension, and wherein the first dimension is greater than the second dimension.

9. A knee pad comprising:

an upper support;

a lower support;

a shell coupled to the upper support and the lower support, the shell positioned between the upper support and the lower support; and a single, integral padding layer comprising:

an outer surface positioned along the shell;

an inner surface; and a plurality of cells, each of the plurality of cells extending between the outer surface and the inner surface, each of the plurality of cells comprising:

a channel connecting the outer surface and the inner surface;

a longitudinal axis of the channel extending along a major axis of the channel; and a cell wall enclosing the channel, the cell wall comprising:

an inward angled segment; and an outward angled segment;

wherein the inward angled segment and the outward angled segment are each angled relative to the longitudinal axis along a height of the cell wall.

10. The knee pad of claim 9, wherein the height of the cell wall is defined between the outer surface and the inner surface, and wherein the inward angled segment is angled inward, toward an opposing portion of the cell wall and wherein the outward angled segment is angled outward, away from the opposing portion of the cell wall.

11. The knee pad of claim 9, wherein the cell wall comprises two inward angled segments and two outward angled segments.

12. The knee pad of claim 9, wherein an interior surface of the inward angled segment is at a 30 degree angle relative to an axial axis of the cell.

13. The knee pad of claim 9, wherein each cell wall a thickness defined between an exterior surface of the cell wall and an interior surface of the cell wall, wherein the thickness is 2 mm.

14. The knee pad of claim 13, wherein a padding layer thickness is less than 25 mm.

15. The knee pad of claim 9, wherein each cell has a height defined between the outer surface and the inner surface of the padding layer, and wherein the height is about 17.5 mm.

16. A knee pad comprising:

an upper support;

a lower support;

a shell coupled to the upper support and the lower support, the shell positioned between the upper support and the lower support; and a single, integral padding layer comprising:

an outer surface positioned along the shell;

an inner surface; and a plurality of cells, each of the plurality of cells extending between the outer surface and the inner surface, each of the plurality of cells comprising:

a channel connecting the outer surface and the inner surface;

a longitudinal axis extending between the outer surface and the inner surface; and a cell wall surrounding the channel, the cell wall comprising:

a pair of inward angled segments; and a pair of outward angled segments;

wherein the pair of inward angled segments and the pair of outward angled segments are each angled relative to each other along a length of the longitudinal axis.

17. The knee pad of claim 16, wherein one of the pair of outward angled segments is positioned between the pair of inward angled segments along a height of the cell wall.

18. The knee pad of claim 16, wherein the shell further comprises:

a front wall; and a pair of lateral walls, each lateral wall extending from an opposing side of the front wall;

and wherein the padding layer further comprises:

a central section positioned against the front wall of the shell; and side sections positioned against the pair of lateral walls of the shell.

19. The knee pad of claim 18, wherein the plurality of cells in the central section have a first dimension and the plurality of cells in the side sections have a second dimension, and wherein the first dimension is greater than the second dimension.

20. The knee pad of claim 16, wherein the padding layer is formed from a thermoplastic elastomer.

21. The knee pad of claim 1, wherein the height of the cell wall is defined between the outer surface and the inner surface.

* * * * *